US005946009A

United States Patent [19]

Youn

[11] Patent Number: 5,946,009

[45] Date of Patent: Aug. 31, 1999

[54] SERVICE STATION FOR INK-JET PRINTER

[75] Inventor: Karp-Sik Youn, Suwon, Rep. of Korea

[73] Assignee: SamSung Electronics Co., Ltd., Suwon, Rep. of Korea

[21] Appl. No.: 08/838,330

[22] Filed: Apr. 8, 1997

[30] Foreign Application Priority Data

Apr. 8, 1996 [KR] Rep. of Korea ..... 96-7532
Apr. 1, 1997 [KR] Rep. of Korea ..... 97/6629

[51] Int. Cl.[6] ..... B41J 2/165

[52] U.S. Cl. ..... 347/32; 347/29; 347/22; 347/33; 347/36; 347/37

[58] Field of Search ..... 347/22, 29, 32, 347/33, 36, 37

[56] References Cited

U.S. PATENT DOCUMENTS 5,394,178 2/1995 Grange ..... 347/32
5,801,725 9/1998 Neese et al ..... 347/32

FOREIGN PATENT DOCUMENTS 405096740 4/1993 Japan ..... B41J 2/165
407047679 2/1995 Japan ..... B41J 2/165

*Primary Examiner*—N. Le
*Assistant Examiner*—Shih-Wen Hsieh
*Attorney, Agent, or Firm*—Robert E. Bushnell, Esq.

[57] ABSTRACT

A service station for an inkjet printer provides for wiping and sealing a nozzle of the printer's head as the head is moved to the printer's service zone from a printing zone by a carriage, includes a mobile head service having a wiper for cleaning the nozzle, a cap for sealing the nozzle, and a waste ink storage groove holding waste ink from the nozzle; a rotating member moving the mobile head servicer in the direction of the head's movement by the carriage's moving force; a lifting cam elevating the mobile head servicer rotating by the rotating member by stages so that the wiper and cap come in contact with the nozzle, thus scaling the nozzle; and restoring means making the mobile head servicer and rotating member return to their original neutral position.

13 Claims, 9 Drawing Sheets

SERVICE STATION FOR INK-JET PRINTER

CLAIM OF PRIORITY

This application makes reference to, incorporates the same herein, and claims all benefits accruing under 35 U.S.C. §119 from an application entitled *Service Station for Ink-jet Printer* earlier filed in the Korean Industrial Property Office on the $8^{th}$ day of Apr. 1996, and there duly assigned Ser. No. 96-7532 by that Office, and an application earlier filed in the Korean Industrial Property Office on the $1^{st}$ day of Apr. 1997, and there duly assigned Ser. No. 97-6629.

BACKGROUND OF THE INVENTION

1. Field of the Invention

The present invention relates to a service station for an ink-jet printer which serves to clean a nozzle of the printer's head, catches waste ink, and seals the nozzle, and more particularly, to a service station operating under power of a print head carriage to clean the nozzle of the head of an ink-jet printer, to hold waste ink, and to seal the nozzle.

2. Discussion of Related Art

A conventional ink-jet printer includes a paper feeding mechanism, which feeds sheets of paper into the printer one by one; a paper conveyance mechanism conveying the paper thorough the printer as images and characters are printed one line at a time onto the paper; a printing mechanism forming the images and characters on the paper in ink; and a paper delivery mechanism discharging the paper to a output tray upon completion of the printing. A conventional ink-jet printer also typically includes a service station that is essential to optimal printer performance, which to maintains the head by cleaning the print head print nozzle, holding waste ink, and sealing the nozzle.

In contemporary designs of ink-jet printers, the path of movement travelled by a head may be divided into a printing zone, an accelerating/decelerating zone, and a service zone, with a service station being installed in the service zone. These service stations typically depend upon movement provided via a multi-component gear train that limits the cleaning operation to those occasions when the print head is within the service zone. Moreover, the number of components in the gear train, in my opinion, unnecessarily slows the servicing of the print head by the service station and contributes to excessive costs of manufacturing the printer. I have observed that conventional service stations lack any waste ink storage function. Recent efforts to improve the wiping and sealing functions performed on the print head by the service station have tended to increase the length of the path travelled by the print head, thereby making the printer somewhat larger than is desirable. The combined length of the printer's printing zone, accelerating/decelerating zone and service zone constitutes the overall length of the printer. The printing zone corresponds to the width of print media, and its length can not be feasibly reduced. The accelerating/decelerating, zone is made for reducing the speed of the carriage and I have found that there is a practicable limit restricting any effort to reduce its length. I have therefore found that while only the service zone can be reduced to create a compact design, the length of the service zone increases with any increase in the length of the service station, a factor that directly contributes to the size of the printer.

SUMMARY OF THE INVENTION

Accordingly, it is an object of the present invention to provide an improved process and apparatus for improving the servicing of the head of an ink-jet printer.

It is another object to provide a process and apparatus for improving the servicing of the head of an ink-jet printer without increasing the size of the printer.

It is still another object to provide a process and apparatus using minimal additional components to improve the servicing of the print head of an ink-jet printer.

It is yet another object to provide a process and apparatus interacting with the motion of a carriage transporting the print head of an ink-jet printer, to improve the timeliness and quality of the servicing of the print head.

It is still yet another object to provide a process and a service station apparatus for an ink-jet printer which can wipe a nozzle of the print head, quickly seal the nozzle, hold waste ink, and minimize its range of motion while operating by interacting with the motion of the carriage that transports the print head in order to eliminate extra driving means.

To achieve these and other advantages, and in accordance with the purpose of the present invention as embodied and broadly described, a service station process and apparatus for an ink-jet printer are provided with a wiper and cap that are operated by interactions with the printer carriage, to catch and hold waste ink spitting from a nozzle of the printer's head after wiping the nozzle with the wiper and before sealing the nozzle with the cap. More specifically, the service station wipes and seals a nozzle of the printer's head as the head is moved by the carriage to the printer's service zone from a printing zone. This mobile head service station may be constructed with a wiper for cleaning the nozzle, a cap for sealing the nozzle, and a waste ink storage groove for holding waste ink removed from the nozzle. A rotating member using the moving force of the carriage transporting the head moves this mobile head service station in the direction of the head; a lifting cam elevates the mobile head service station by rotating the rotating member in stages so that the wiper and cap come in contact with the nozzle and seal the nozzle. A restoring mechanism returns the mobile service station and rotating member to their original neutral position. The wiper and cap are installed on the mobile head service station with a tilt so that the wiper and cap meet the nozzle when moving in the direction of the head's movement.

The rotating member includes a lever that rotates in response to the movement of the carriage; a shaft makes the lever rotate about a predetermined point, and a lifting arm connects the shaft with the mobile head service station and makes the rotating member move up and down. A lifting cam includes a height regulating body that makes the rotating member move up and down, with a neutral stage, a wiping stage, a waste ink storing stage and an enclosed stage arranged in tiers. An elastic member is mounted on the height regulating body to apply force to the rotating member, and a connecting shaft joins the elastic member with the rotating member so that the elastic member and the rotating member may operate on the height regulating body. A restoring mechanism may be an elastic member drawing the mobile head service station.

BRIEF DESCRIPTION OF THE ATTACHED DRAWINGS

A more complete appreciation of the invention, and many of the attendant advantages thereof will be readily apparent as the same becomes better understood by reference to the following detailed description when considered in conjunction with the accompanying drawings in which like reference symbols indicate the same or similar components, wherein:

FIG. 1 schematically depicts the service zone of a hypothetical representation of a conventional ink-jet printer;

DETAILED DESCRIPTION OF PREFERRED EMBODIMENT

The service station, as already known, is used to maintain the head and is essential to optimal printer performance.

Figure 1:
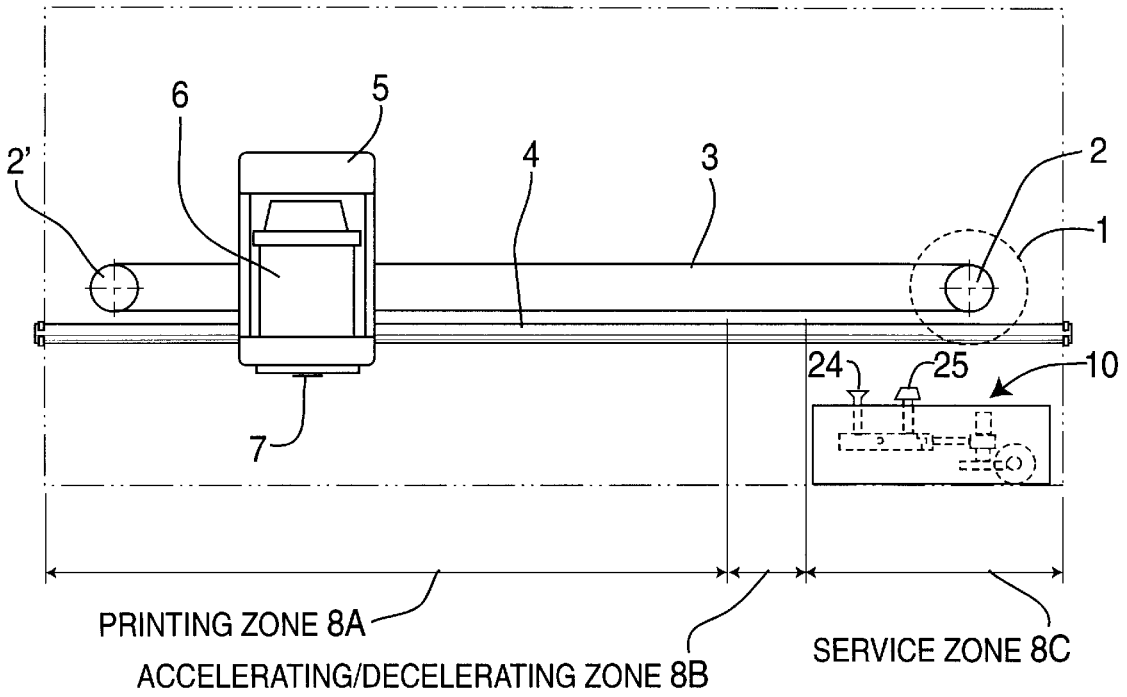

FIG. 1 shows the location of a conventional service station 10 for an ink-jet printer. The printer carriage 5 traverses right and left, moved by pulleys 2 and 2' and belt 3 under the guidance of a guide rail 4 so that head 6 follows a rectilinear path. The head's moving zones are divided into a printing zone 8A, an accelerating/decelerating zone 8B, and a service zone 8C; service station 10 is installed in the service zone.

Figure 2:
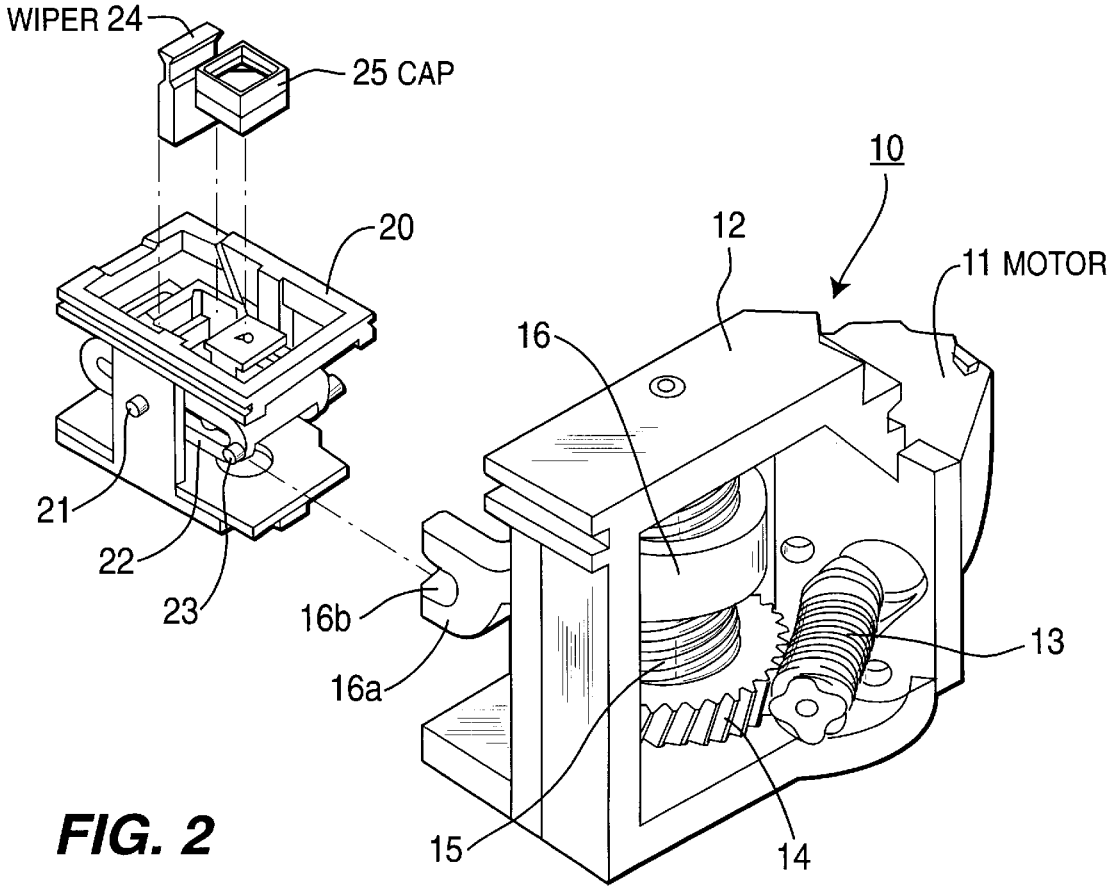
FIG. 2 is an exploded-perspective view of a conventional service station for an ink-jet printer.

FIG. 2 depicts the conventional service station 10 for an ink-jet printer. Service station 10 is equipped with a forward/reverse motor 11 which powers the operation. Forward/reverse motor 11 drives a worm 13, installed in a subassembly frame 12, driving gear 14 which turns screw shaft 15 forward and reverse. Fork carrier 16 is threaded onto screw shaft 15 so as to move upwardly and downwardly according to the forward/reverse rotation of screw shaft 15. A fork 16*a*, fixed to fork carrier 16, moves upwardly and downwardly with the movement of fork carrier 16. An axle slot 16*b* is formed in fork 16*a* which matches pin 23, attached to seesaw board 22, so that the seesaw board moves in seesaw fashion about a fulcrum shaft 21. A wiper 24 and a cap 25 are installed on either side of seesaw board 22.

Figure 3A:
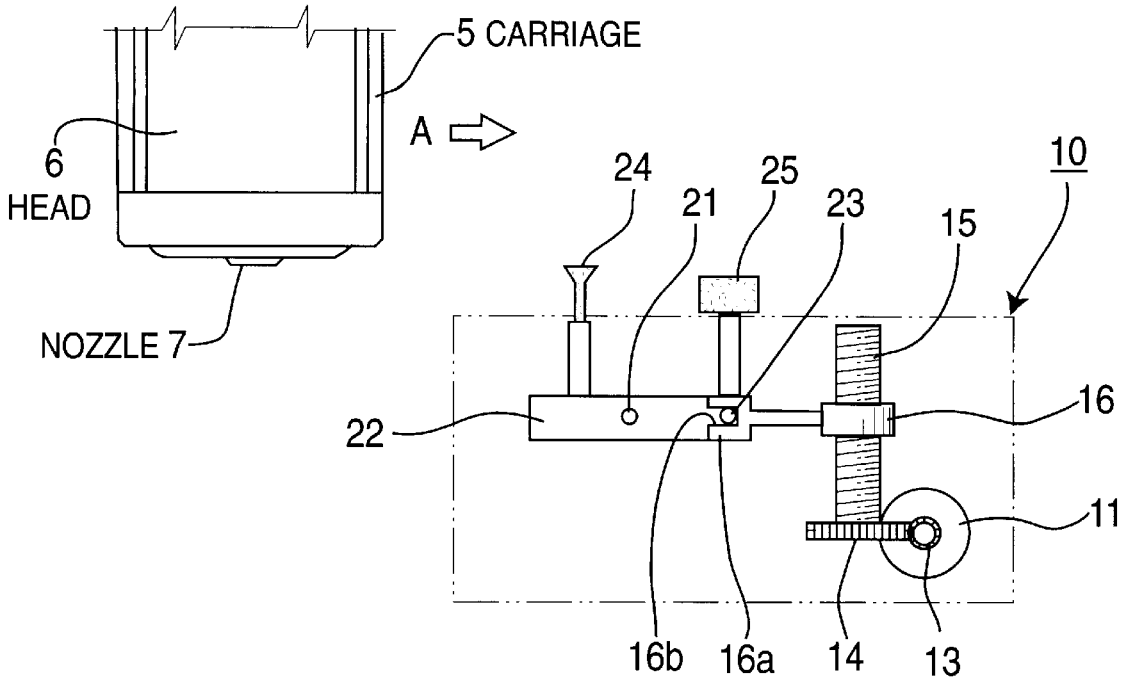
FIGS. 3A to 3C are elevational operational views illustrating distinct steps in the movements performed by the operating mechanism of a conventional service station.

FIG. 3A depicts the neutral state of a conventional service station 10. In this state, seesaw board 22 is horizontal and head 6, attached to carriage 5, carries out printing in the printing zone. Forward/reverse motor 11 comes to a standstill, and a control circuit controls the action of forward/reverse motor 11. Once head 6 completes printing, it is moved in the direction of arrow A into the service zone by carriage 5. As it is moved into the service zone 8C, service station 10 carries out the cleaning operation and the capping operation using wiper 24 and cap 25.

Figure 3B:
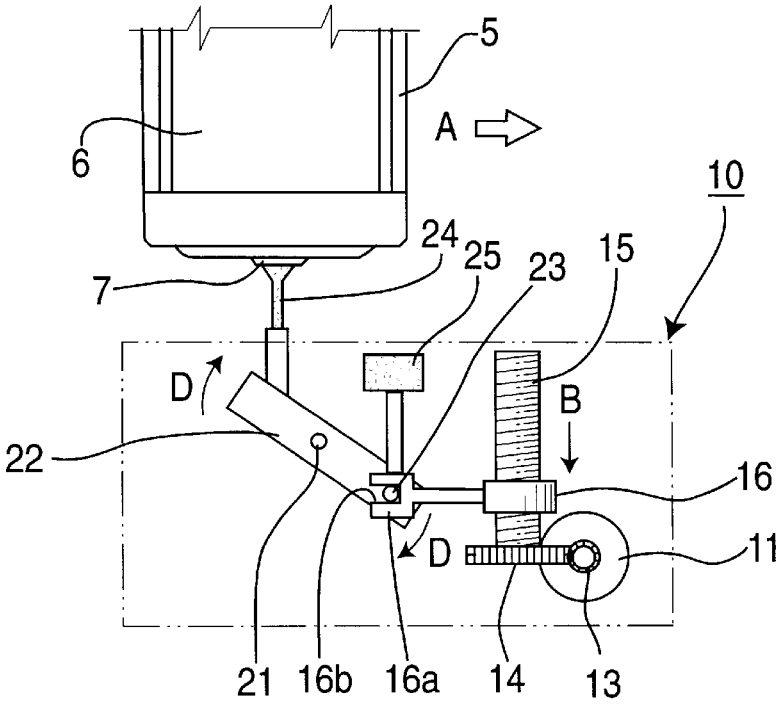

FIG. 3B shows the cleaning operation performed by service station 10. During the forward rotation of forward/reverse motor 11, worm 13, worm wheel 14 and screw shaft 15 rotate in a forward direction, and fork carrier 16 descends in direction B. Seesaw board 22 pivots about fulcrum shaft 21 as shown by arrows D so that wiper 24 is elevated. Wiper 24 wipes nozzle 7 of head 6 as nozzle 7 passes overhead before the capping operation is carried out.

Figure 3C:
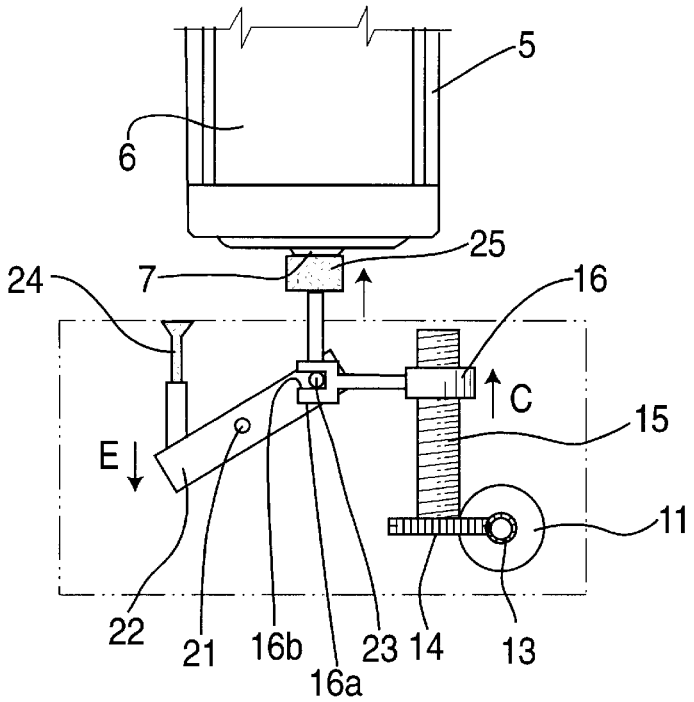

FIG. 3C shows the capping operation of service station 10. As forward/reverse motor 11 reverses direction, fork carrier 16 ascends in direction C, and seesaw board 22 pivots as shown by arrow E so that wiper 24 descends and cap 25 ascends to cover and thereby seal nozzle 7.

With a conventional service station 10, wiper 24 and cap 25 alternately move up and down as motor 11 drives the mechanism composed of worm 13, worm wheel 14, screw 15, fork carrier 16, and seesaw board 22. I have observed that the number of components in this gear train slows the up-and-down movements of wiper 24 and cap 25. Wiper 24 must clean nozzle 7, not only when the printer idles but also during the printing operation. With contemporary designs however, I have found that when service station 10 goes into action to carry out the cleaning operation only, when forward/reverse motor 11 operates to pivot seesaw board 22 about fulcrum shaft 21 so that wiper 24 moves up-and-down, which, in my opinion, takes excessive time. Thus, forward/reverse motor 11 goes into action after stopping carriage 5, moving head 6, which requires considerable time. The capping operation is also, in my opinion, unnecessarily delayed, since it takes time to perform the cleaning and capping operation; this is another factor that reduces the reliability of the product. In addition, a long screw shaft 15 must be installed in the conventional service station 10 which is disadvantageous in making the printer compact. Moreover, conventional service station 10 does not have a waste ink storage function.

It may be appreciated therefor, that the conventional service station consists of a complicated mechanism, increasing production costs and the size of the printer.

In order to solve the above-described problems, Korean Utility Model application No. 96-6268 proposed a service station that can operate without any extra driving mechanism. This service station serves to wipe and seal the nozzle of a printer head with a wiper and cap that are moved up and down by the motion of the carriage as the carriage moves into the printer service zone. Since the wiper and cap are designed to move up and down by the movement of the carriage, the service station may be considered to be somewhat long, which makes the printer large.

Referring again to FIG. 1, the combined length of the printing zone 8A, accelerating/decelerating zone 8B and service zone 8C constitutes the overall length of the printer. The printing zone 8A corresponds to the width of print media, and its length can not be reduced. The accelerating/decelerating zone 8B is made for reducing the speed of the carriage and I have observed that there is a limit to the possibility of any reduction of its length. Accordingly, I have found that while only the service zone can be reduced to create a compact design, as the length of the service station increases, the service zone also increases, which is a factor that increases the size of the printer.

Figure 4:
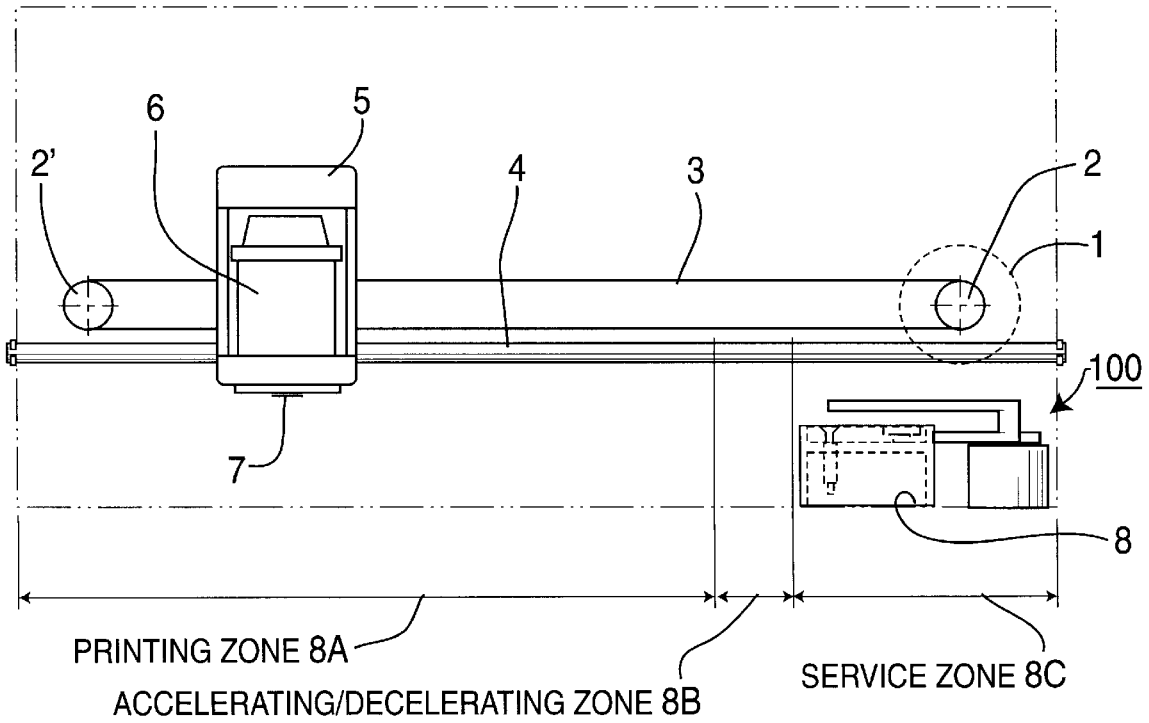
FIG. 4 depicts a service station for an ink-jet printer constructed in accordance with the principles of the present invention.
Figure 5:
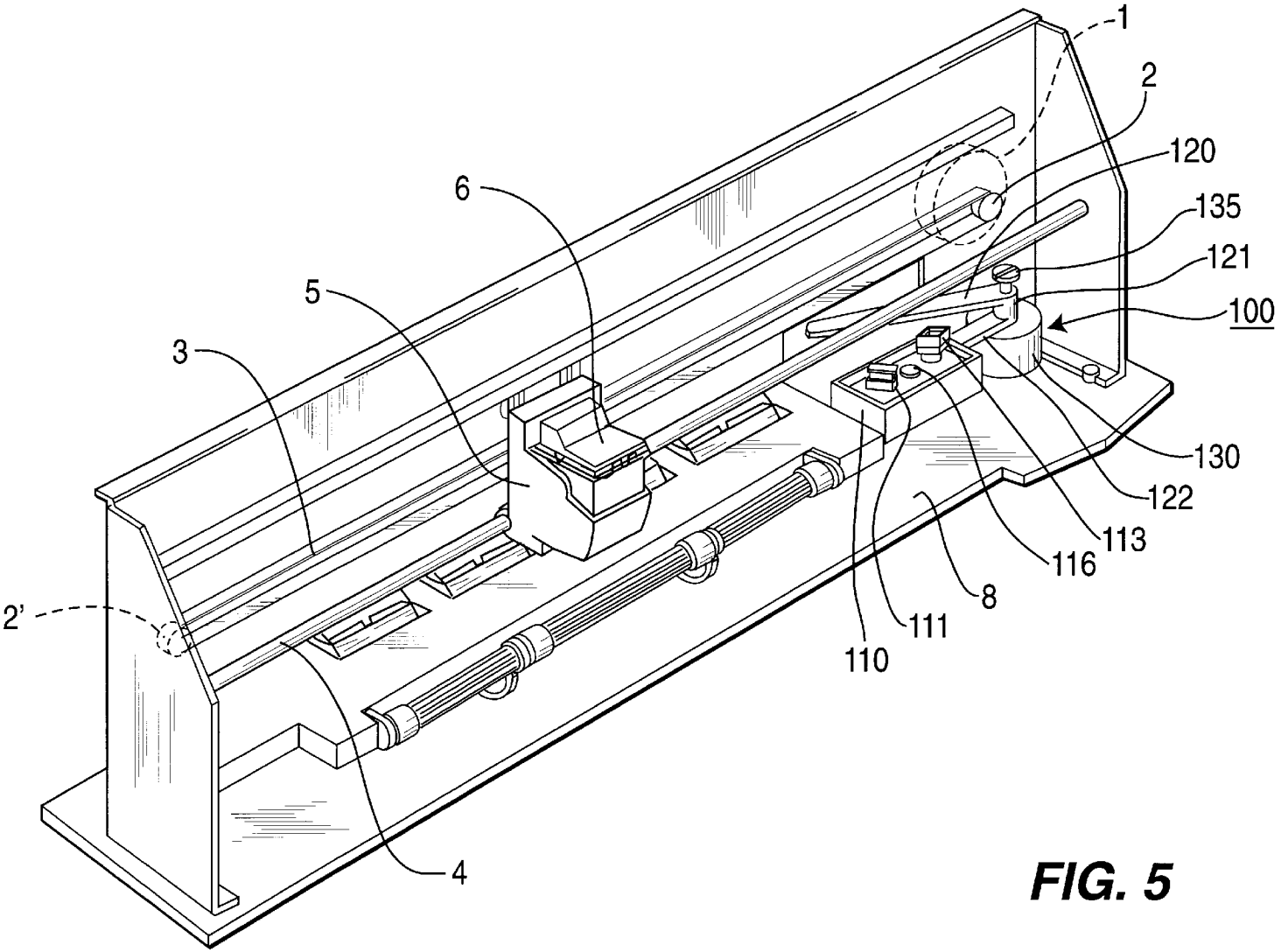
FIG. 5 is a perspective view of the service station in accordance with the principles of the present invention.
Figure 6:
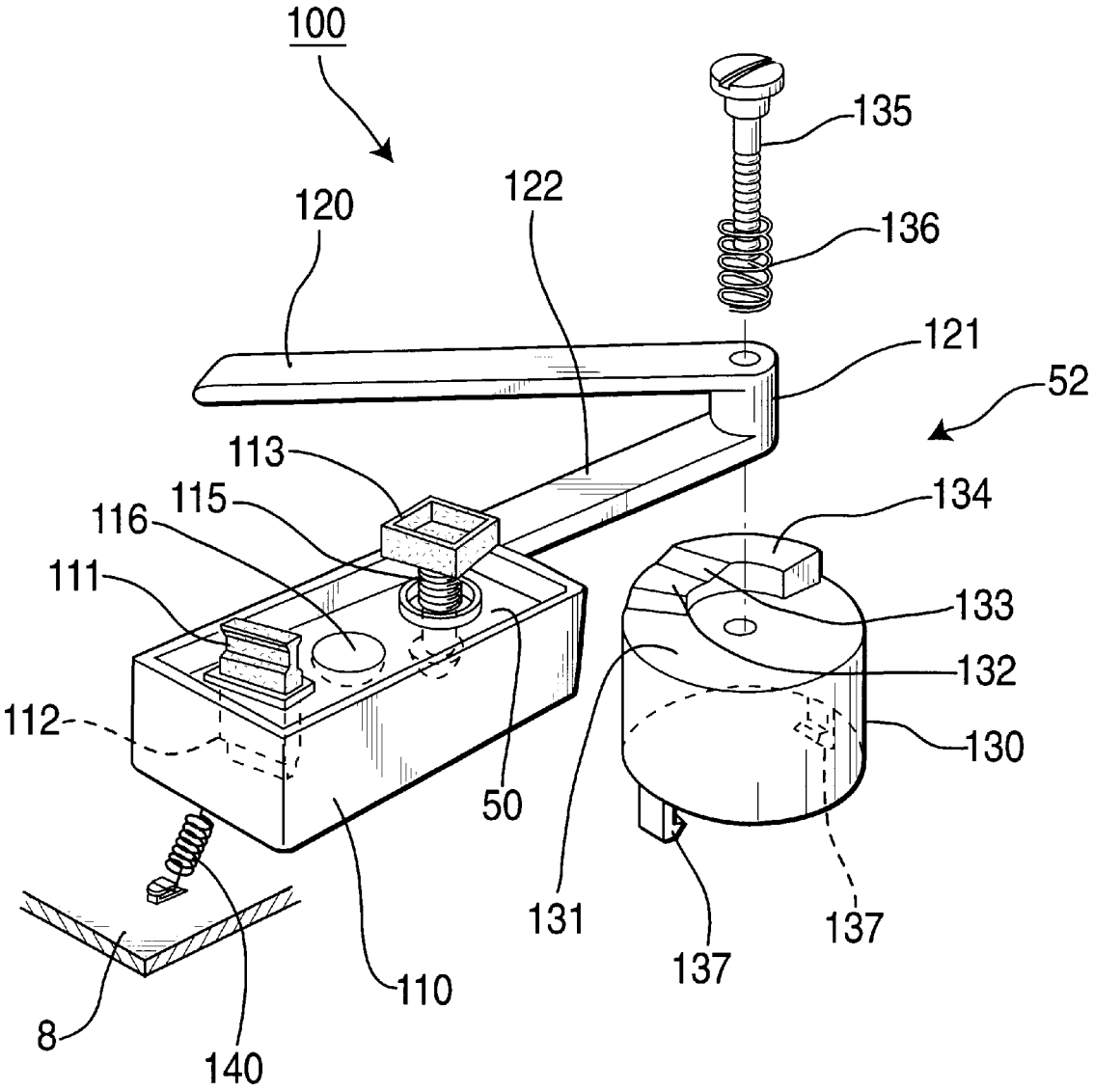
FIG. 6 is an exploded-perspective view of a service station for an ink-jet printer constructed in accordance with the principles of the present invention.

As shown in FIGS. 4 and 5, a service station 100 for an ink-jet printer serves to clean and seal the nozzle 7 of the printer's head 6, which is attached to carriage 5 that traverses right and left by pulleys 2 and 2' and belt 3, driven by forward/reverse bi-directional motor 1 under the guidance of guide rail 4. Service station 100 is installed in the printer's service zone 8C to which head 6 is transported by carriage 5, as it passes through the printer printing and accelerating/decelerating zones 8A, 8B. Such a service station 100 will be now described in detail with reference to FIGS. 5, 6, 7A and 7B.

Service station 100 may be constructed with a wiper 111 for wiping nozzle 7 of head 6, a cap 113 for sealing nozzle 7, a mobile head servicer 110 with a waste ink storage port 116 formed in the floor 50 of the body of mobile head service 110 holds waste ink emitted from nozzle 7, a rotating member for rotating mobile head servicer 110 in the direction of head 6's movement by carriage 5, a lifting cam 130 that lifts mobile head servicer 110 in increments as the rotating member moves so that wiper 111 and cap 113 wipe and seal nozzle 7, and a restoring mechanism which returns mobile head servicer 110 to its original position.

Wiper 111, mounted on mobile head servicer 110 to project upwardly from the floor 50 of body 110, is made of rubber, and secured to a wiper stand 112 that is injection molded along with mobile head servicer body 110. Cap 113, made of rubber, is installed on a supporting shaft 114, and forced upwards by a spring 115. Accordingly, cap 113 seals nozzle 7 with give provided by spring 115 coaxially mounted around shaft 114 to prevent binding. Mobile head servicer 110 is designed to have waste ink storage groove 116 positioned between wiper 111 and cap 113.

Figure 7A:
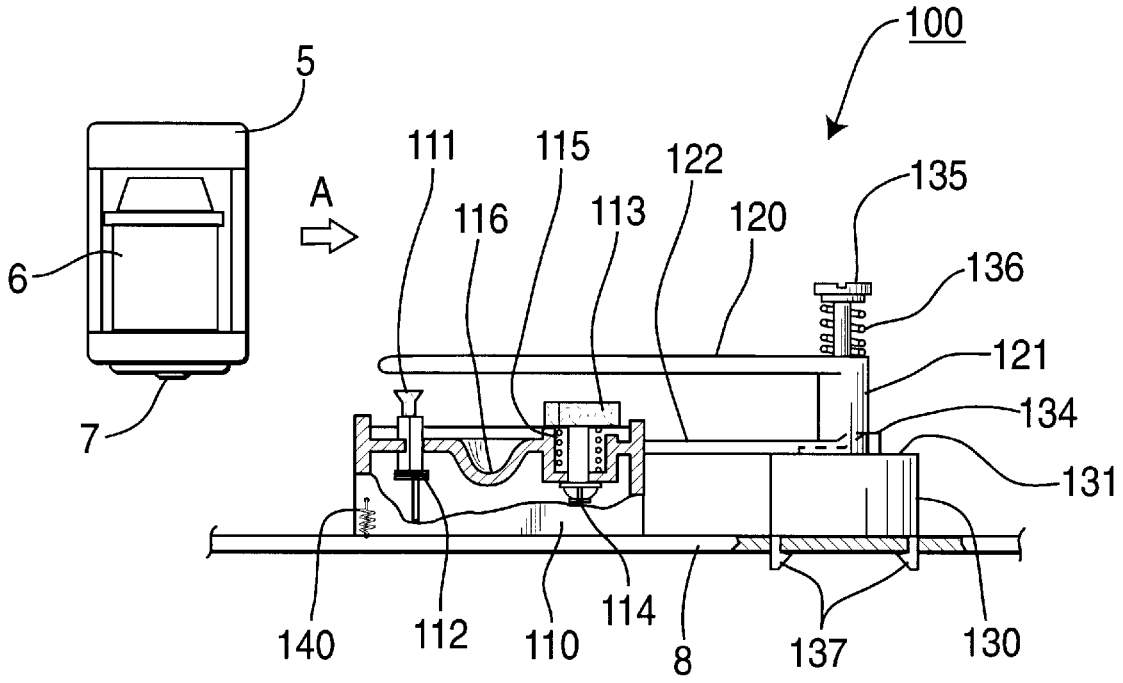
FIG. 7A is a front elevational view of a service station for an ink-jet printer constructed in accordance with the principles of the present invention.
Figure 7B:
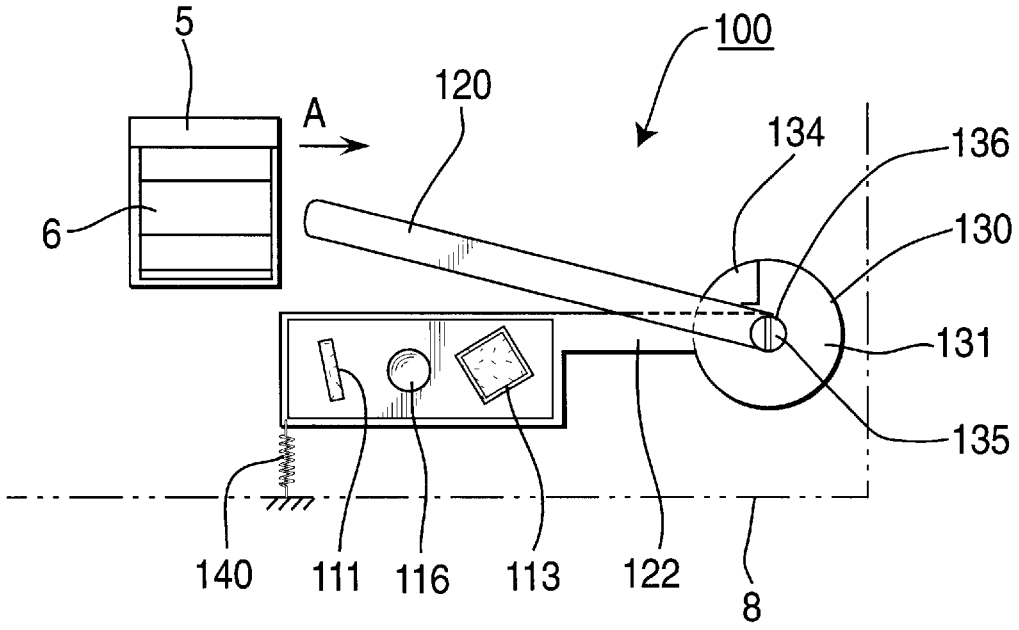
FIG. 7B is a plan view of a service station for an ink-jet printer constructed in accordance with the principles of the present invention.

As shown in FIG. 7B, wiper 111 and cap 113 are installed with an angle of inclination and are obliquely oriented relative to the direction of travel shown by arrow A, of carriage 5, and cap 113 must rise more than wiper 111 because cap 113 should meet nozzle 7 as the mobile head servicer 110 moves during the cleaning and capping operations. The rotating mechanism 52 makes mobile head servicer 110 move in the direction of movement of head 6 and has a lever 120 which pivots, as it interacts with moving carriage 5, a shaft 121 about which lever 120 pivots, and a lifting arm 122 carrying head servicer 110 that is lifted while it also pivots about a connecting shaft 135 coaxially installed within shaft 121.

Preferably, lever 120, shaft 121 and lifting arm 122 are formed integrally, although they may be separately manufactured to be assembled as a single unit afterwards. Lever 120 and lifting arm 122 are designed to form a predetermined acute angle therebetween on the plan view, in order that carriage 5 catches and displaces lever 120 only to deliver its moving force to lever 120. The rotating mechanism 52 has a height regulating body 130 that regulate; the height of mobile head servicer 110. Height regulating body 130 includes a neutral stage 131 that places mobile head servicer 110 be in a neutral position, a wiping stage 132, which is higher than neutral stage 131 by one incremental stage, a waste ink storing stage 133, which is higher than wiping stage 132, having a slanted surface that is inclined between stages 132, 134, and an enclosed stage 134, that is incrementally higher than waste ink storing stage 133. These stages 131 to 134 are arranged in incremental tiers, and height regulating body 130 is fixed on the printer's frame 8 by snaps 137 and remains stationary relative to lever 120 and arm 122.

On height regulating body 130 is a connecting shaft 135 on which shaft 121 pivots, and an elastic member 136 is mounted on height regulating body 130, to press shaft 121 against height regulating body 130. Preferably, a coil spring serves as elastic member 136, although another type of spring may be used as elastic member 136, Shaft 121 is designed to rotate about connecting shaft 135, and lifting arm 122, coaxially mounted on shaft 121, is positioned to normally contact neutral stage 131, and in response to movement of lever 120, rotates to sequentially contact wiping stage 132, waste ink storing stage 133 and enclosed stage 134 as it sweeps through its range of motion.

The restoring means serves to return mobile head servicer 110 to the original, neutral, position after completion of the servicing operation. The restoring mechanism includes an elastic member 140, that under expansion due to displacement of servicer 110, draws mobile head servicer 110 toward its original position. The ends of elastic member 140 are connected between the bottom of mobile servicing case 110 and frame 8, respectively. Preferably, a coiled tension spring serves as elastic member 140, although another-type of spring may be used.

Figure 8:
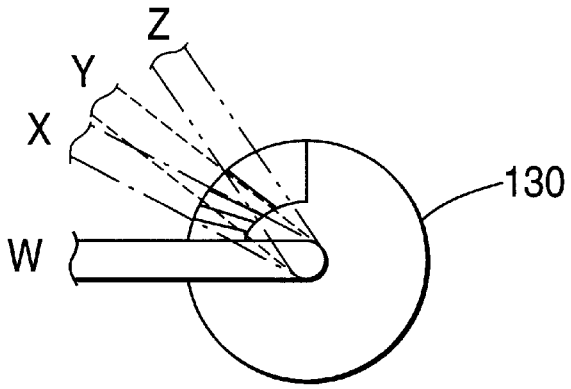
FIG. 8 is a plan view of a lifting cam that may be incorporated into a service station for an ink-jet printer constructed in accordance with the principles of the present invention.
Figure 9A:
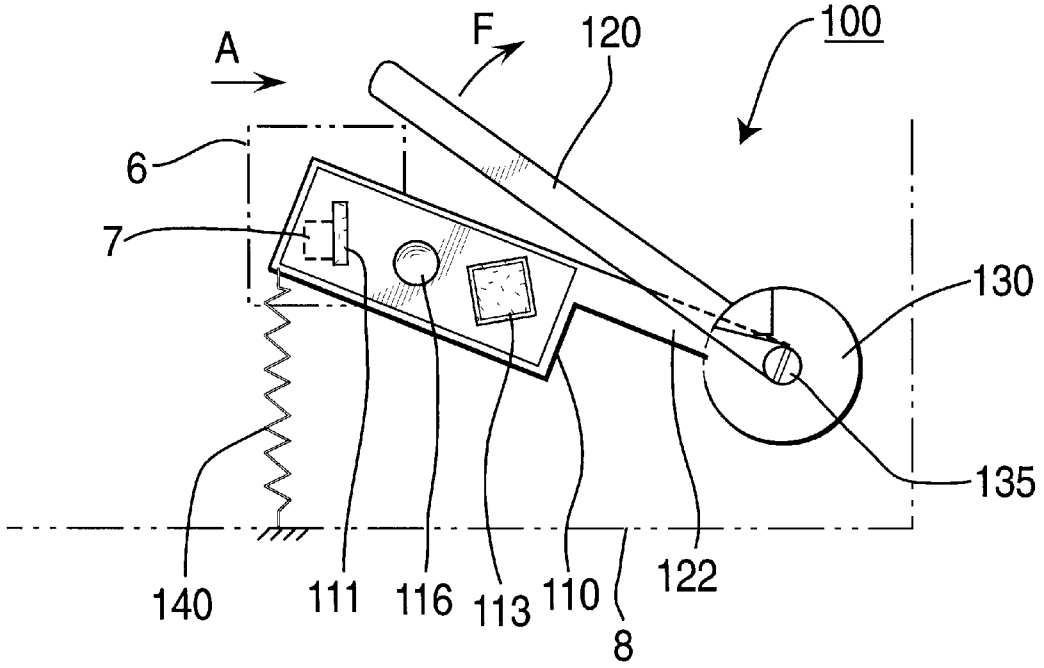
FIG. 9A is a plan view illustrating a cleaning operation performed by a service station for an ink-jet printer in constructed in accordance with the principles of the present invention.

FIGS. 7A and 7B depict the neutral stage of service station 100 with wiper 11 and cap 113 obliquely oriented to the direction of travel A of carriage 5. Service station 100 goes to the neutral stage when head 6 on carriage 5 carries out printing in the printing zone, Thus, as service station 100 is in the neutral position, mobile head servicer 110 is pressed by elastic member 140, and lifting arm 122 rests on neutral stage 131, at position W shown by FIG. 8 of height regulating body 130. Wiper 111 and cap 113, on mobile head servicer 110 get out of the traveling direction A of head 6. At this point, when carriage 5 moves into the service zone, lever 120 is engaged and rotatingly displaced by carriage 5, and moving force of carriage 5 is transmitted to lever 120 so that lever 120 turns clockwise about shaft 135, as shown in FIG. 9A. As rotating lever 120 turns, lifting arm 122, mobile head servicer 110 and shaft 121 rotate at the same time, and lifing arm 122 is moved upward as it follows height regulating body 130 to wiping stage 132, at position X shown by FIG. 8 from neutral stage 131. All the components connected with lifting arm 122 are, lifted, and as mobile head servicer 110 rotates and ascends, wiper 111 is flush with nozzle 7 of head 6, and wipes ink from nozzle 7.

Figure 10:
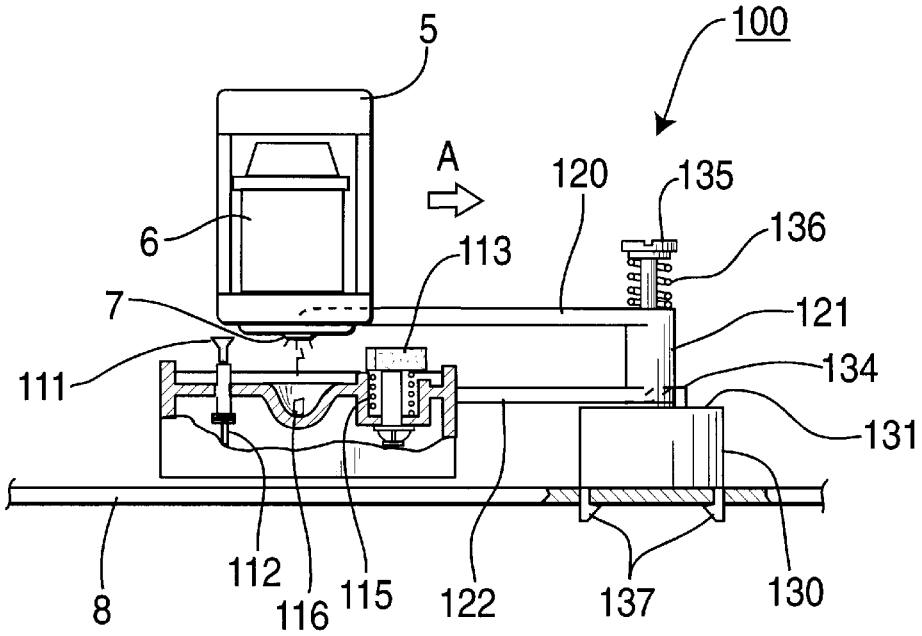
FIG. 10 is a front-sectional view illustrating the waste ink storage mechanism of a service station constructed in accordance with the principles of the present invention.

The cleaning operation is carried out while head 6 including carriage 5 is moving, and carriage 5 continues to traverse. Lever 120 continues rotating clockwise by carriage 5, and lifting aim 122 is positioned on waste ink storing stage 133 of height regulating body 130, position Y of FIG. 8. As shown in FIG. 10, waste ink storage groove 116 is placed right under nozzle 7 of head 6. The waste ink held in waste ink storage groove 116 evaporates gradually, and waste ink dropping from nozzle 7 can be held in waste ink storage groove 116.

Figure 9B:
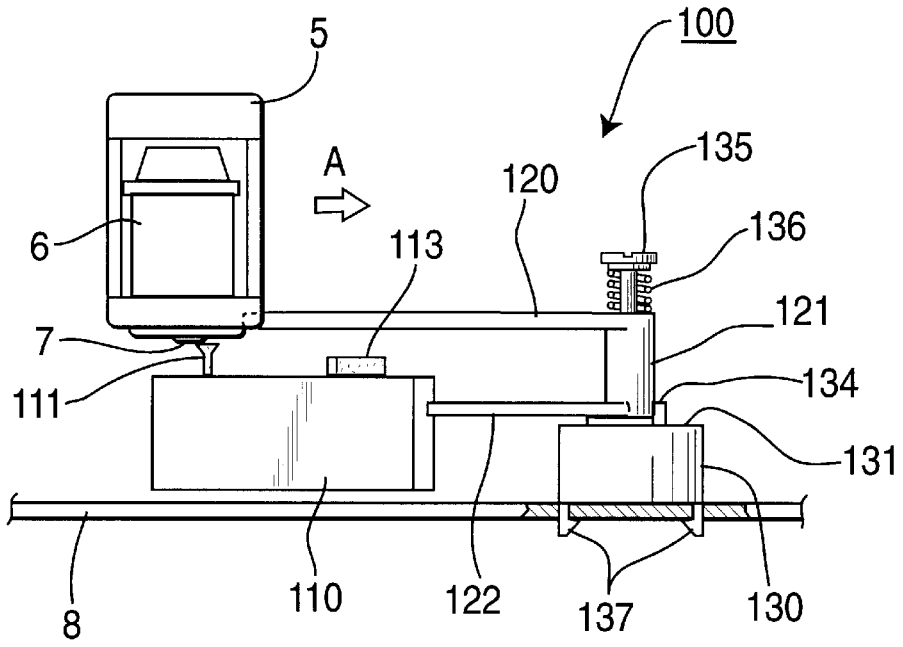
FIG. 9B is a side elevational view illustrating the cleaning operation performed by a service station constructed in accordance with the principles of the present invention.
Figure 11A:
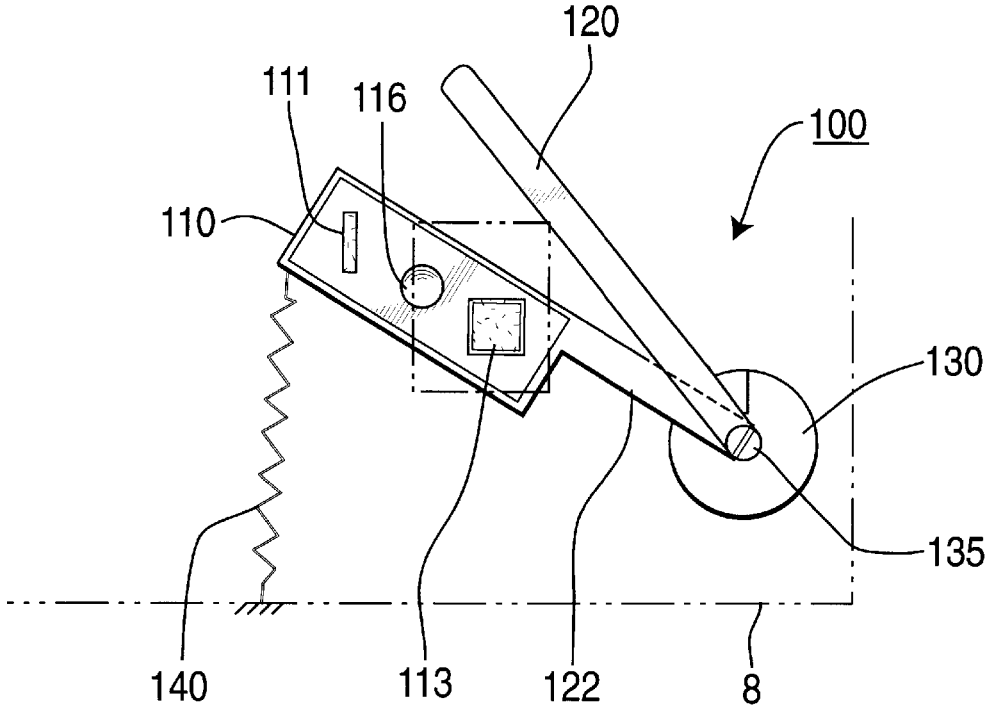
FIG. 11A is a plan view illustrating a capping operation performed by a service station constructed in accordance with the principles of the present invention.
Figure 11B:
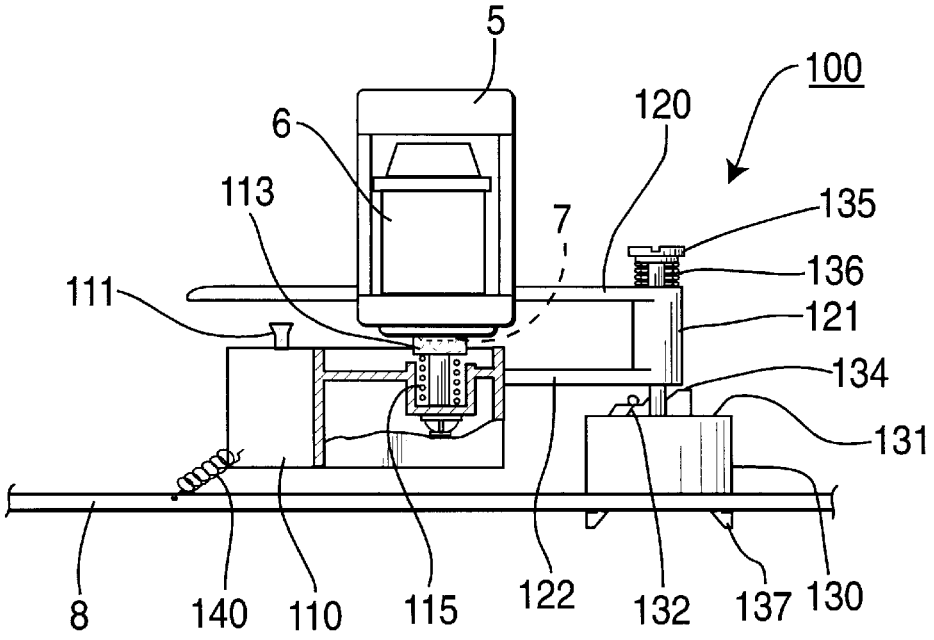
FIG. 11B is a front view illustrating the capping operation shown in FIG. 11A.

FIGS. 9A and 9B depict the capping operation of service station 100 that is performed right after completion of the waste ink storage operation. Lever 120 continues rotating clockwise, arrow F, by carriage 5's continuous movement after completion of the waste ink storage operation. As lifting arm 122 turns about connecting shaft 135, it is moved to enclosed stage 134 of height regulating body 130 at position 2 of FIG. 8, in such a manner that mobile head servicer 110 is elevated as shown in FIGS. 11A and 11B.

Cap 113 comes in close contact with nozzle 7 of head 6 by the rotating and rising motion of mobile head servicer 110, and seals nozzle 7, thus preventing ink from nozzle 7 from drying out. Once the capping operation is completed, carriage 5 stops moving, and the printer is turned off. If the printer is subsequently turned on again for printing, carriage 5 travels to the printing zone. Once carriage 5 starts to operate, lever 120 is freed, and mobile head servicer 110 and its integral parts such as lifting arm 122, shaft 121, and lever 120 rotates counter clockwise under the biasing force provided by the drawing force of elastic member 140 so that lifting arm 172 is moved downwardly, returning to its neutral stage 131.

In head servicing station 100 of the present invention elastic member 136, mounted on connecting shaft 135, continuously applies downward pressure on shaft 121. Since shaft 121 remains in contact with height regulating body 130, it comes close to neutral stage 131 and enclosed stage 134 when lifting arm 122 rotates and ascends or descends, and its dislocation is prevented. In addition, service station 100 may perform the cleaning operation to obtain the best print quality. For this operation, carriage 5 moves to the position shown by FIG. 9A where the cleaning operation is performed and traverses to the printing zone again, and service station 100 only wipes nozzle 7 with wiper 111.

Service station 100 carries out the cleaning operation rapidly, and the, printer with the inventive service station 100 offers rapid printing. This service station 100 is operated by the momentum created by the movement of carriage 5 moving force without any driving means, which simplifies its constriction and lowers the production costs. In addition, since this service station serves to wipe the nozzle, store waste ink, and seal the nozzle in order, there is no need to install an extra waste ink storing means in an ink-jet printer, and the present invention offers improved printer performance.

This service station wipes and seals the nozzle, with the wiper and cap rotating and moving upward, and saves much space compared to a conventional service station that makes rectilinear and up-and-down movements whereby its overall height and length can be reduced. This can reduce the printer's service zone in length and ensures compactness of the printer.

It will be apparent to those skilled in the art that various modifications and variations can be made in, the service station for in ink-jet printer of the present invention without departing from the spirit or scope of the invention. Thus, it is intended that the present invention cover the modifications and variations of the invention provided they come within the scope of the appended claims and their equivalents.

What is claimed is:

1. A service station for an ink-jet print head, comprising:

a carriage for moving the print head to a service zone;

a rotating member in the service zone for rotating in response to a moving force of the carriage;

a mobile head servicer in the service zone, connected to the rotating member and rotating in response to rotation of the rotating member, said mobile head servicer comprising:

a wiper for cleaning a nozzle of the print head;

a cap for sealing the nozzle; and a storage groove for holding waste ink from the nozzle;

a height regulating body connected to the rotating member and the mobile head servicer, for elevating the rotating member by stages in response to rotation of the rotating member; and restoring means for restoring the position of the rotating member when the carriage moves out of the service zone.

2. The service station of claim 1, further comprising:

said mobile head servicer being approximately rectangular in shape, the rectangular shape being oriented angled to the direction of movement of the printhead when the mobile head servicer rotates to service the print head.

3. The service station of claim 2, further comprising:

the cap on the mobile head servicer being lower than the wiper.

4. The service station of claim 2, further comprising:

the storage groove being located between the wiper and the cap.

5. The service station of claim 2, further comprising:

the wiper and cap being mounted on the mobile head servicer at an angle to the rectangular shape, for proper positioning of the wiper and cap when the mobile head servicer rotates to service the print head.

6. The service station of claim 1, said rotating member further comprising:

a shaft;

a lever rotating around the shaft, said lever contacting the carriage when the print head moves to the service station; and a lifting arm connecting the shaft with the mobile head servicer.

7. The service station of claim 6, further comprising:

said lever being positioned to contact the carriage when the print head is moved to the service zone; and said lifting arm being oriented below said lever arm and at a specified angle to the lever arm for positioning the mobile head servicer below the print head when said lever contacts the carriage.

8. The service station of claim 6, further comprising:

said mobile head servicer being oriented to rotate clockwise when the print head moves to the service station; and the clockwise rotation of the mobile head servicer sequentially orienting the wiper, the storage groove and the cap under the nozzle.

9. The service station of claim 1, further comprising:

said height regulating body having an approximately cylindrical shape and comprising:

a neutral stage;

a wiping stage;

a waste ink storage stage; and a capping stage;

said stages arranged in tiers on the height regulating body;

an elastic member mounted on the height regulating body for applying a force to the rotating member; and a connecting shaft connecting the elastic member with the rotating member.

10. The service station of claim 9, said elastic member being a compression coil spring.

11. The service station of claim 1, said restoring means being an elastic member for applying force to the mobile head servicer.

12. The service station of claim 11, said elastic member being a tension coil spring.

13. A service station for an ink-jet printer, wiping and sealing a nozzle of the printer's head as the head is moved to the printer's service zone from a printing zone by a carriage, said service station comprising:

a mobile head servicer having a wiper for cleaning the nozzle, a cap for sealing the nozzle, and a waste ink storage groove holding waste ink from the nozzle, a rotating member having a lifting arm connected with the mobile head servicer, a lever connected with the lifting arm and turning in a direction of the head's movement by the carriage's moving force, and a shaft connecting the lever with the lifting arm and making the lever rotate about a predetermined point;

a lifting cam including a height regulating body making the rotating member move up and down and having a neutral stage, a wiping stage, a waste ink storing stage, and an enclosed stage arranged in tiers;

an elastic member mounted on the height regulating body to give pressure to the rotating member; and a connecting shaft connecting the elastic member with the rotating member so that the elastic member and the rotating member may operate on the height regulating body.

* * * * *